US005942845A

United States Patent [19]

Matsubara

[11] Patent Number: 5,942,845

[45] Date of Patent: Aug. 24, 1999

[54] DEFLECTION YOKE APPARATUS

[75] Inventor: Tohru Matsubara, Saitama-ken, Japan

[73] Assignee: Kabushiki Kaisha Toshiba, Kawasaki, Japan

[21] Appl. No.: 08/988,931

[22] Filed: Dec. 11, 1997

[30] Foreign Application Priority Data

Dec. 12, 1996 [JP] Japan ..... 8-332408

[51] Int. Cl.[6] ..... H01J 29/70

[52] U.S. Cl. ..... 313/440; 335/210; 335/213

[58] Field of Search ..... 313/440; 335/210, 335/211, 212, 213, 214

[56] References Cited

U.S. PATENT DOCUMENTS 4,786,838 11/1988 Meershoek et al. ..... 313/440

5,801,481 9/1998 Yokota ..... 313/440

FOREIGN PATENT DOCUMENTS 8-287844 11/1996 Japan .

*Primary Examiner*—Nimeshkumar D. Patel

*Attorney, Agent, or Firm*—Pillsbury Madison & Sutro LLP

[57] ABSTRACT

In an inner bobbin 50, which has a deflection coil 80 wound on the inside face and has a ferrite core 70 to be arranged on the outside face, a plurality of guides 53, which support and connect a screen side base 51 and a neck side base 52, are connected with each other at a position near the neck side by forming a bridge 54, thereby decreasing deformation of guides when a deflection coil is wound, and constantly stabilizing winding distribution of deflection coil. Thus, a deflection yoke apparatus with little irregularity in function is realized. Further, with the provision of a recess 73 on the inside face of a ferrite core 70 to fit with said bridge 54 provided on the inner bobbin 50, the positioning of the ferrite core 70 against the inner bobbin 50 has become easy and reliable.

3 Claims, 10 Drawing Sheets

K = L / 3

DEFLECTION YOKE APPARATUS

BACKGROUND OF THE INVENTION

1. Field of the Invention

The present invention relates generally to a deflection yoke apparatus to be mounted on the cathode ray tubes of television receivers or display apparatus.

2. Description of the Related Art

Generally, a deflection yoke apparatus comprises a horizontal deflection coil and a vertical deflection coil. Deflection coils are classified by a winding pattern into two types; saddle type coils which are wound saddle-shaped, and troidal type coils which are wound in a troidal form. A deflection yoke apparatus in which saddle type coils are used for each of horizontal deflection coil and vertical deflection coil is called a saddle-saddle type deflection yoke apparatus.

As shown in FIG. 13, a deflection yoke apparatus 30 has a hollow shape which gradually expands from the neck side toward the screen side. This deflection yoke apparatus 30 is designed to be inserted with its screen side into the back side of a cathode ray tube (CRT) 40 to be mounted in the funnel part.

FIG. 14 is a side view, seen from the outside, of a deflection yoke apparatus before winding. FIG. 15 is a sectional view of FIG. 14, wherein a deflection yoke apparatus before the winding of a horizontal deflection coil and a vertical deflection coil is shown.

In FIGS. 14 and 15, the deflection yoke apparatus 30 has an inner bobbin 31 and an outer bobbin 32, which work as a holder to hold a ferrite core 33, a horizontal deflection coil and a vertical deflection coil (not shown). The ferrite core 33 is arranged between the inner bobbin 31 and the outer bobbin 32. The ferrite core 33 is made of a magnetic material. The ferrite core 33 is shaped with its screen side in an expansively opening form. The combined body of the bobbins 31, 32 and the ferrite core 33 is made to form a bell-shape as a whole.

The inner and outer bobbins 31, 32 are made of non-magnetic material such as polypropylene resin. The front side of them (the screen side) is formed in an expansively opening shape. The inner bobbin 31 is designed to have the neck part of a cathode ray tube (CRT) inserted from the expansively opening side, as shown in FIG. 13. And on the inside face of the inner bobbin 31, a pair of vertical deflection coils (not shown) are arranged along the grooves between a plurality of guides 311, being wound to generate a magnetic field in a vertical direction of the CRT screen.

On the outside face of the inner bobbin 31, the ferrite core 33 is arranged, and the outside of the ferrite core 33 is designed to be held down by the outer bobbin 32. The inner bobbin 31 and the outer bobbin 32 are designed to be fastened at the circular screen side base and at the circular neck side base, and the ferrite core 33 is to be placed and held between the inner bobbin 31 and the outer bobbin 32.

On the inner bobbin 31, a plurality of guides 311 are formed to connect each base on the screen side and the neck side. Besides, both ends of said plurality of guides 311 are extended to form a plurality of guide hooks 311*a* and 311*b*, the cross section of which is L-shaped (or inverse L-shaped).

Also, along a plurality of grooves (in other words, slits), which are formed between a plurality of guides 311 to connect the screen side base with the neck side base, and at the same time, the electric wire, as a vertical deflection coil, is wound around close to the inside face of the inner bobbin 31 to wind between said plurality of guide hooks 311*a* and 311*b*, the cross section of which is L-shaped (or inverse L-shaped). The winding pattern is, as shown in FIG. 16, guided by a plurality of grooves between each of guides 311 to go, as shown by the circled numbers in the figure, like 1→2→3→4→5→6→7→8→9 and so on. Each winding of 2→3→4, 5→6→7→8, 9→10→11→12 and so on is done a plurality of times before goes on to the next groove.

FIG. 17 illustrates a conventional deficiency which arises when winding is done at the D part of FIG. 15. FIG. 18 is a sectional view at the C—C line of FIG. 15.

As shown in FIG. 15, all the plurality of guides 311, which also serve as supports of the inner bobbin 31, are narrow in width as the guides approach the neck side (the upper part of the figure) from the screen side (the lower part of the figure). This is because the groove width between the guides 311 is set to be uniform from screen side to neck side for convenience of winding, and the guide width is forced to be narrowed on the neck side where the diameter of the opening is small.

In conventional structures shown in FIGS. 14 and 15, when an electric wire is wound into the grooves which are formed between the guides 311 of the inner bobbin 31, a bundle of electric wire is aggregated with the narrow guides in between at the neck side where the guide width is narrow and the diameter of the opening is small. As a result, as shown in FIG. 17, the guides 311 are pushed outwardly by the electric wire 34 wound in to cause deformation. Accordingly, the distribution of electric wire slips out from an intended distribution, enlarging the possibility to cause irregularity in the function of a deflection yoke.

In order to prevent the guides from being deformed, conventionally, adhesive 36 is used to fix the clearance between the guide 311 of the inner bobbin 31 and the ferrite core 33, as shown in FIG. 18. This method, however, requires both an additional process to apply the adhesives and additional time for the adhesives to dry completely. This has been an issue in workability and cost.

As stated above, with a conventional deflection yoke apparatus, when electric wire is wound, the way to accumulate it may push guides to cause deformation, change the distribution of winding, and cause a problem of irregularity in the functions of the deflection yoke apparatus. Application of adhesives, as a means to cope with these issues, has imposed this problem in workability and the like.

SUMMARY OF THE INVENTION

An object of the present invention is to provide a deflection yoke apparatus wherein deformation of guides, at the time when electric wire is wound, is prevented, and irregularity in distribution of winding and function decreases.

Another object of the present invention is to provide a deflection yoke apparatus which is durable and simple to assemble.

A first embodiment of the present invention is a deflection yoke apparatus comprising: a core which is formed in a shape which is gradually expanding from a neck side toward a screen side, and a bobbin which is arranged along an inner surface of said core, is provided with a screen side base, a neck side base and a plurality of guides formed between the screen side base and the neck side base, and is wound with electric wire in a space between the guide hooks provided at said screen side base and the guide hooks provided at said neck side base to form a deflection coil along grooves formed between said plurality of guides, wherein a bridge is provided in order to connect said plurality of guides formed on said bobbin and to regulate spaces between said plurality of guides.

According to the first embodiment of the present invention, with the provision of a bridge structure between a plurality of guides on the bobbin, deflection of guides, which is caused by loading on winding, is removed, winding of electric wire between each guide becomes steady, guide deformation is controlled, and distribution of winding is stabilized. Thus, a deflection yoke apparatus with little irregularity in function is realized.

A second embodiment of the present invention is a deflection yoke apparatus comprising: a core which is formed in a shape which is gradually expanding from a neck side toward a screen side, and a bobbin which is arranged along an inner surface of said core, is provided with a screen side base, a neck side base and a plurality of guides formed between the screen side base and the neck side base, and is wound with electric wire in a space between the guide hooks provided at said screen side base and the guide hooks provided at said neck side base to form a deflection coil along grooves formed between said plurality of guides, wherein a bridge is provided on the outside face of said plurality of guides formed on said bobbin to regulate spaces between said plurality of guides, and a recess is provided on the inside face of said core to fit with said bridge provided on the outside face of said bobbin.

According to the second embodiment of the present invention, besides the provision of a bridge structure on the outside face of the bobbin, a recess is formed on the inside face of the core to make the bridge of the bobbin fit into the recess of the core. Thus, guide deformation on the bobbin is prevented, and at the same time, positioning of the core to the bobbin becomes easy when the core is arranged to the bobbin.

A third embodiment of the present invention is, a deflection yoke apparatus according to the first or second embodiment of the present invention, wherein said bridge is provided at a position about ⅓ to the neck side of the guide length between said screen side base and said neck side base.

According to the third embodiment of the present invention, with the provision of a bridge at a position near the neck side (approximately ⅓), the guide interval on the neck side, where guide deformation tends to occur, is regulated and stability of winding distribution can be promoted.

DETAILED DESCRIPTION OF THE PREFERRED EMBODIMENTS

Figure 1:
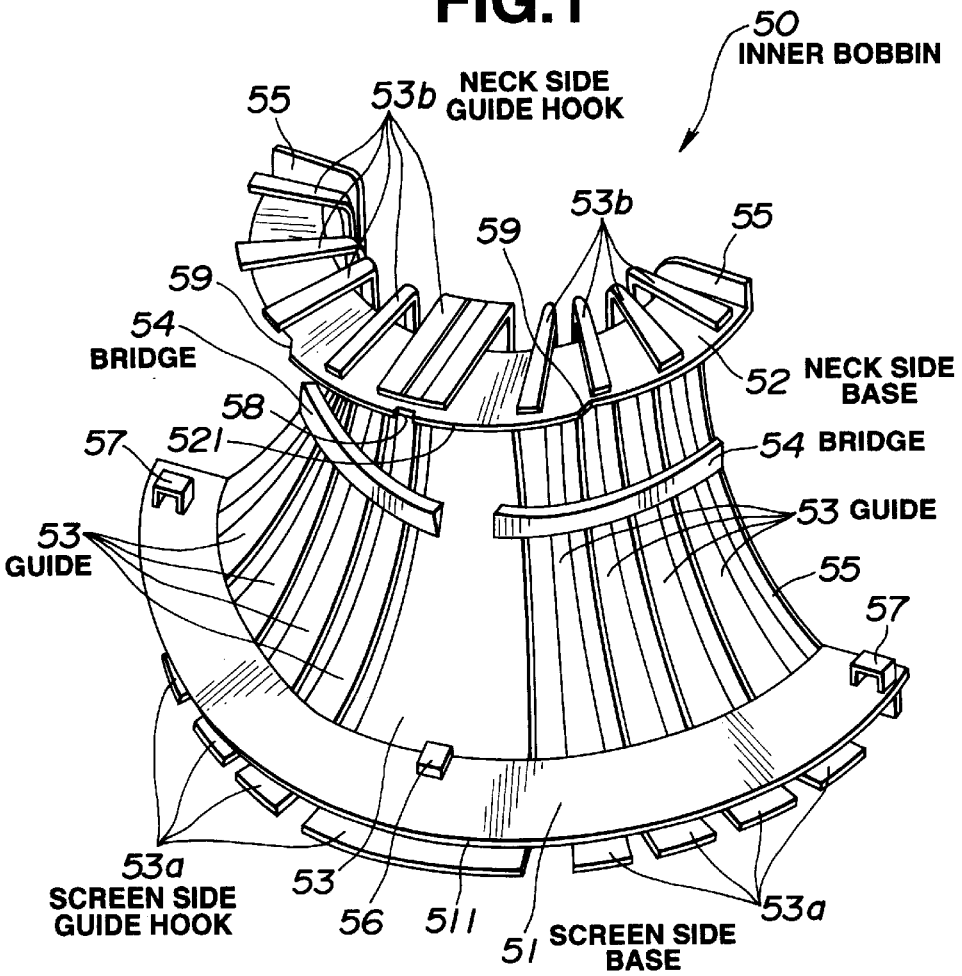
FIG. 1 is a perspective view of a half body of the inner bobbin in a deflection yoke apparatus according to an embodiment of the invention.
Figure 2:
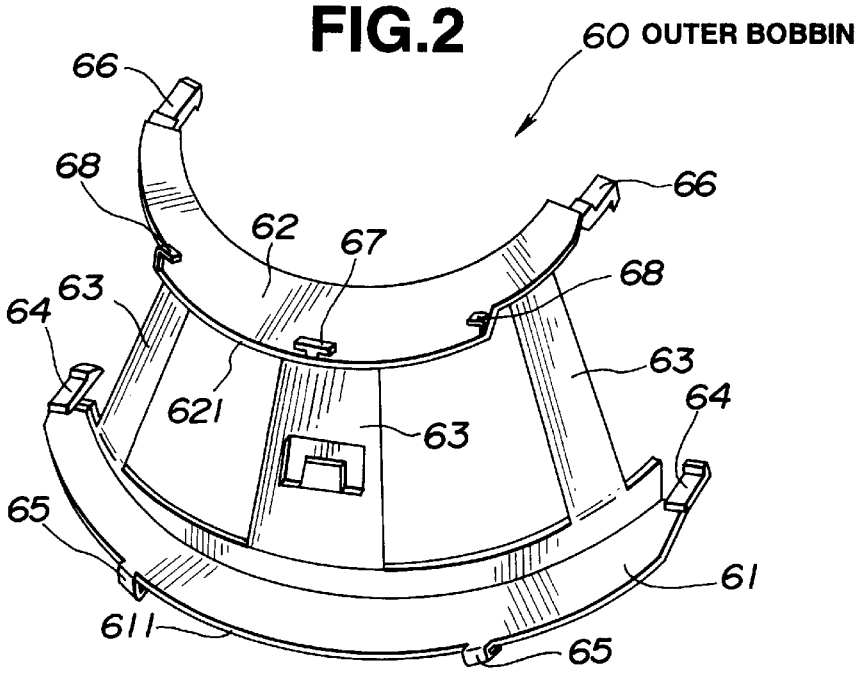
FIG. 2 is a perspective view of a half body of the outer bobbin to be attached to the half body of the inner bobbin shown in FIG. 1.
Figure 3:
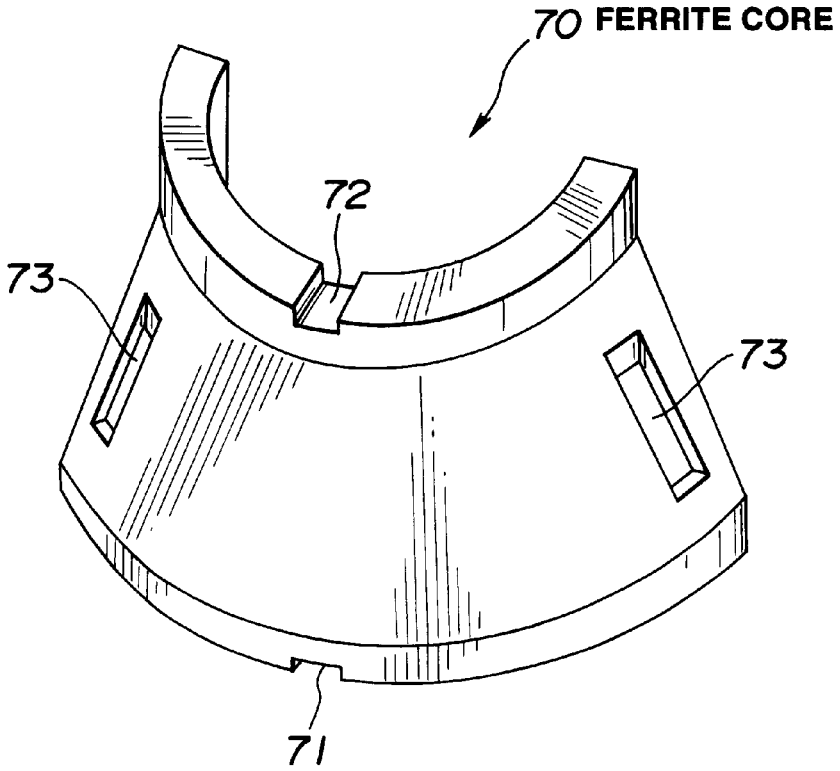
FIG. 3 is a perspective view of the outside of a half body of the ferrite core which is to be fit to the half body of the inner bobbin shown in FIG. 1.
Figure 4:
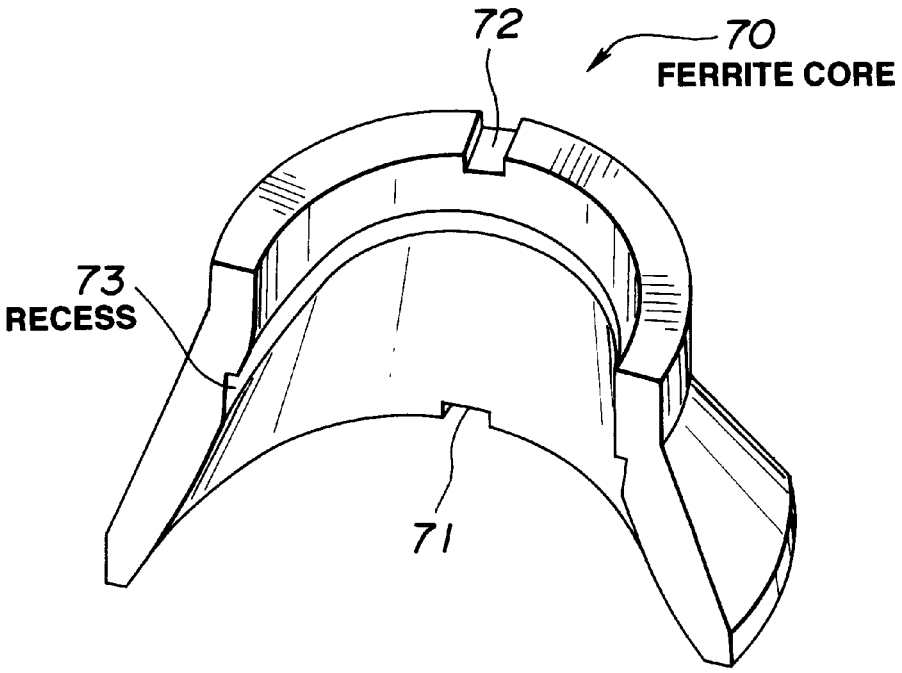
FIG. 4 is a perspective view of the inside of a half body of the ferrite core shown m FIG. 3.

The present invention will now be described in detail with reference to the accompanying drawings which illustrate embodiments thereof FIG. 1 is a perspective view of a half body of the inner bobbin in a deflection yoke apparatus according to an embodiment of the present invention. An inner bobbin 50 is made of a non-magnetic material, such as polypropylene resin, in half bodies to couple, one of which is shown in this figure. The other half body, which is not shown in the figure, has a similar shape. The two half bodies are designed to be combined by supporting frames 55, 55, as a joint, to form one inner bobbin bell-shaped as a whole. FIG. 2 illustrates an outer bobbin 60 which is designed to mount a ferrite core, as a core of magnetic body, on the inner bobbin. FIGS. 3 and 4 show a ferrite core 70 to be mounted on the inner bobbin.

In FIG. 1, the inner bobbin 50, a half body, is provided with a screen side base 51, which is semicircular and troidal, and a neck side base 52, which is semicircular and troidal with a smaller radius than the former. A plurality of guides 53 are formed to connect those bases 51 and 52. Out of a plurality of guides 53, one central guide only is formed broader than others. A plurality of other guides (eight in the figure) are formed narrow with almost the same shape. Any of the plural guides 53 is shaped to gradually and expansively open from the neck side toward the screen side. Thus, bobbin 50 forms a half body bell-shaped as a whole. The screen side end of the guide 53 is extended over the screen side base 51 toward the screen side to form a screen side guide hook 53*a* to latch electric wire for deflection coil. The neck side end of the guide 53 is extended over the neck side base 52 toward the neck side to form a neck side guide hook 53*b* to latch electric wire for deflection coil.

On a face of the screen side base 51 (the surface shown in the figure), an engaging protrusion 56 is formed to engage with an engaging groove 71 of a ferrite core 70 shown in FIGS. 3 and 4. In a similar manner, on a face of the neck side base 52 (the back of the base 52 shown in the figure), an engaging protrusion (not shown) is formed to engage with the engaging groove 72 of the ferrite core 70.

On a face of the screen side base 51 (the surface shown in the figure), the engaging parts 57, 57 are disposed as tunnel-shaped frames at the both ends of the base 51 to mount an outer bobbin 60 shown in FIG. 2. A certain range of the central part 521 of the outer edge of the neck side base 52 protrudes outwards, and at the center of the protruding part 521, an engaging notch 58 is formed to latch the outer bobbin 60 as shown in FIG. 2. Both ends 59, 59 of a protruding part 521 are also designed to be engaging parts to latch the outer bobbin 60.

Further, in order to support both sides of the half body formed by the screen side base 51, the neck side base 52 and a plurality of guides 53, the supporting frames 55, 55 are provided. The supporting frames 55, 55 are formed side by side with a plurality of guides 53 in a guide-like shape to form both end faces (composition plane) of the half body, and shaped into one body together with the bases 51, 52 and a plurality of guides 53.

And the bridge 54 is formed in a ring-shape combined with a plurality of guides 53 at the intermediate position of the plurality of guides 53 to connect those guides 53. In FIG. 1, the bridge 54 is provided in an integral formation covering the outside of a plurality of guides 53 (five guides in the figure) and the outside of the supporting frame 55. The bridge 54 is formed to be a pair in FIG. 1. Each pair of the bridge 54 is formed to connect four narrow guides 53, a supporting frame 55 and one broad guide 53. Although, in FIG. 1, the bridge 54 is formed in a ring-shape, the ring-shape is not indispensable but other shapes such as undulate shape may be applied. Further, each pair of the bridge 54 may be formed in linkage form.

The outer bobbin 60 is provided, after the ferrite core 70 (see FIG. 3) is arranged to contact with the outside of the inner bobbin 50, to fix the ferrite core 70 from outside to the inner bobbin 50.

The outer bobbin 60 is formed into one body as shown in FIG. 2, connected by a plurality of supporting parts 63 (three in the figure), together with a semicircular and troidal screen side base 61 and a semicircular and troidal neck side base 62 with a smaller radius than the former. At both circumferential edges of the screen side base 61, latching pawls 64, 64 are protrusively formed in an integrated manner. At the outer circumference 611 of the screen side base 61, the two engaging hooks 65, 65, which can engage with the outer circumference 511 (see FIG. 1) of the screen side base 51 of said inner bobbin 50, are provided with proper interval. The latching pawls 64, 64 are able to be engaged with the engaging parts 57, 57 of said inner bobbin 50. In a similar manner, on both circumferential edges of the neck side base 62, the latching pawls 66, 66 are formed in a protruding shape in an integrated manner, and a certain range in the central part of the outer circumference of the neck side base 62 is formed in an outwardly protruding shape to fit with the shape of the neck side base 52 of said inner bobbin 50 in FIG. 1. At the central part of the protruding part 621, the T-shaped engaging part 67 is formed to be engaged with said engaging notch 58 (see FIG. 1), and at both ends of the protruding part 621, two engaging hooks 68, 68 are formed to be engaged with said engaging parts 59, 59 (see FIG. 1). Latching pawls 66, 66 are able to be engaged with engaging parts (not shown), which have a similar shape to the engaging parts 57, provided on the bottom face of the shown neck side base 52 of said inner bobbin 50.

FIG. 3 is an outside view of a half body of the ferrite core 70. FIG. 4 is a view of FIG. 3 seen from the other side, that is, a view of the inside of the ferrite core 70.

As shown in FIGS. 3 and 4, an engaging groove 71 is formed to be engaged with the engaging protrusion 56 of the screen side base 51 of said inner bobbin 50 on the end face on the screen side of the ferrite core 70, and an engaging groove 72 is formed to be engaged with said engaging protrusion (not shown in the figure) of the neck side base 52 of said inner bobbin 50 on the end face of the neck side. On the outside face of the ferrite core 70, the recesses 73, 73 are formed near both circumferential edges to combine half bodies each other using a spring member (reference numeral 90 in FIG. 12). On the inside face of the ferrite core 70, the recess 73 is formed in a ring-shape to fit with the ring-shaped bridge 54 on the outside face of said inner bobbin 50 when the ferrite core 70 is arranged on the outside face of said inner bobbin 50.

The structure stated above will be described in further detail with reference to FIG. 5 to FIG. 10.

Figure 5:
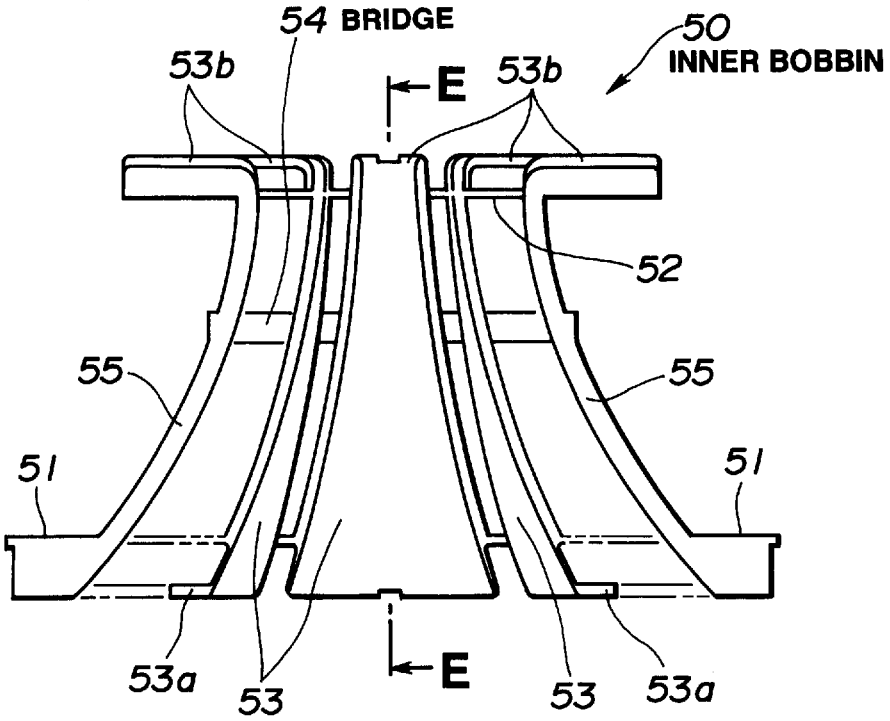
FIG. 5 is a side view of the inside (the composition plane side) of a half body of the inner bobbin shown in FIG. 1.
Figure 6:
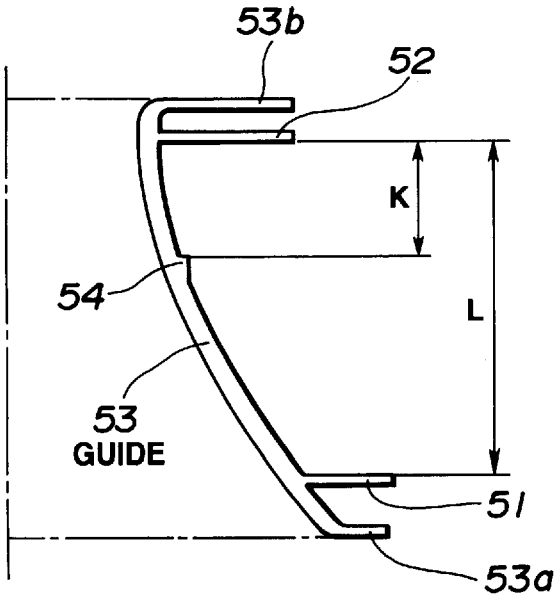
FIG. 6 is an E—E line sectional view of FIG. 5.

FIG. 5 is a side view of a half body of the inner bobbin 50, shown in FIG. 1, seen from inside (from the supporting frame side, that is, the composition plane side). However, a part of the plurality of guides 53 is omitted. FIG. 6 is an E—E line sectional view of FIG. 5.

As shown in FIG. 6, the position of the bridge 54 is set at about ⅓ to the neck side of the guide length so as to sufficiently reinforce the neck side where the guide width is narrow and guides are most apt to be deformed. That is, supposing the interval between the screen side base 51 and the neck side base 52 is L, the distance K of the bridge 54 from the neck side base 52 will be appropriate when $K = L/3$.

Figure 7:
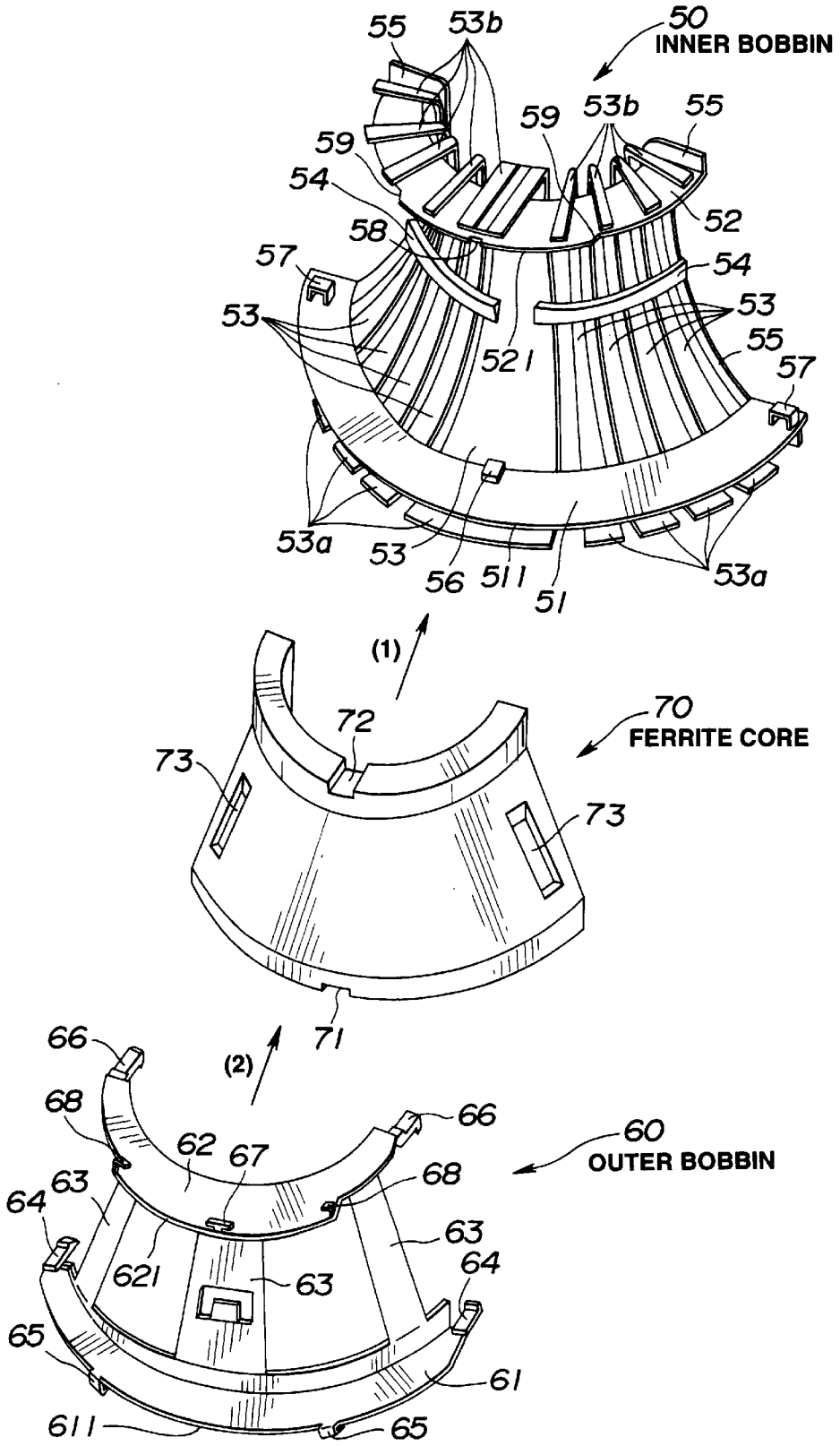
FIG. 7 is a perspective view illustrating the way to assemble each half body of the inner bobbin, the ferrite core and the outer bobbin.

FIG. 7 illustrates how to assemble each half body of said inner bobbin 50, the ferrite core 70 and the outer bobbin 60.

As shown in FIG. 7; (1) first, the ferrite core 70 shown in FIG. 3 (and FIG. 4) is arranged to be fixed against the outside face of a half body of the inner bobbin 50 shown in FIG. 1, (2) further, the outer bobbin 60 in FIG. 2 is latched and fixed against the outside face of the ferrite core 70 in a superposing manner by engaging latching pawls 64, 64, and 66, 66 of the outer bobbin 60 with the engaging parts 57, 57 of the inner bobbin 50 and with the engaging part (not shown) of the neck side base 52 respectively. At this time, the latching pawls 68, 68 are engaged with engaging parts 59, 59, a T-shaped engaging part 67 is engaged with the engaging notch 58, and latching pawls 65, 65 are engaged with the outer circumferential part 511. The assembled state is shown in FIG. 8.

Figure 8:
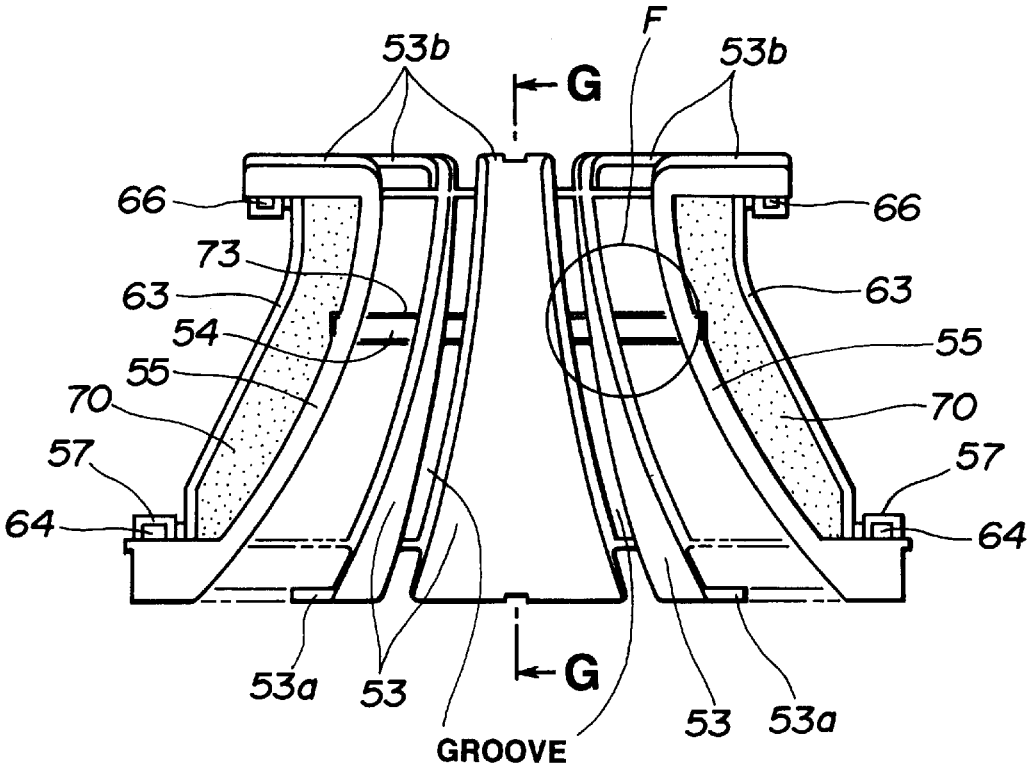
FIG. 8 is a side view of the inside (the composition plane side) of a half body before winding in a deflection yoke apparatus according to an embodiment of the invention.
Figure 9:
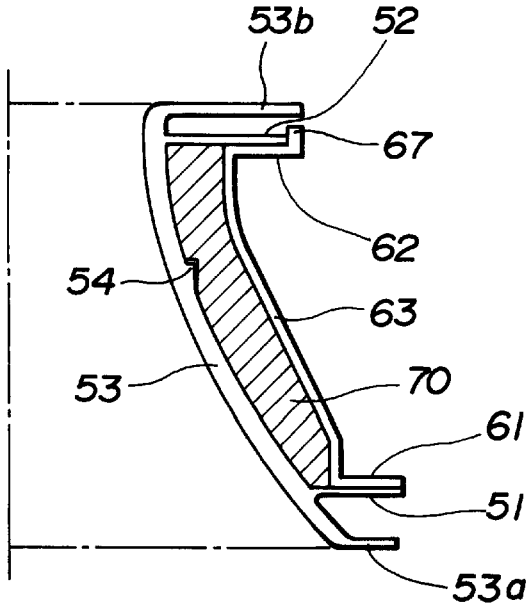
FIG. 9 is a G—G line sectional view of FIG. 8.

FIG. 8 illustrates a half body, seen from the composition plane side of the half body, of a deflection yoke apparatus before winding, in which a ferrite core 70 is fixed between an inner bobbin 50 and an outer bobbin 60. FIG. 9 is a G—G line sectional view of FIG. 8. In practice, a pair of the half bodies of FIG. 8 is matched at faces of the supporting frames 55, 55 to combine both cores. Half bodies are combined each other, using a spring member 90 as shown in FIG. 12.

Figure 10:
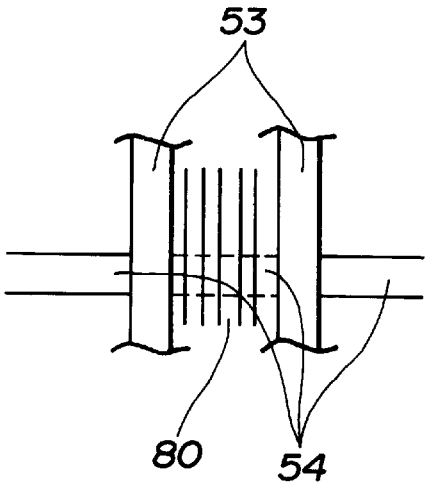
FIG. 10 is an enlarged view of a part F when the half body in FIG. 8 is wound.

With the ferrite core 70 fixed against the inner bobbin 50 as shown in FIG. 8, assembly is done by interfitting the outside shape of the plurality of guides 53 and the supporting frame 55 of the inner bobbin 50 with the inside face of the ferrite core 70. In this embodiment, even when winding of electric wire 80 proceeds from the state of FIG. 8 to the groove (in other words, slit) between the guides 53, 53, the presence of the bridge 54 always keeps intervals between the guides 53, 53 constant without fluctuation, thereby giving highly accurate and stable distribution of winding. FIG. 10 shows an enlarged part F of FIG. 8 when electric wire is wound.

Figure 11:
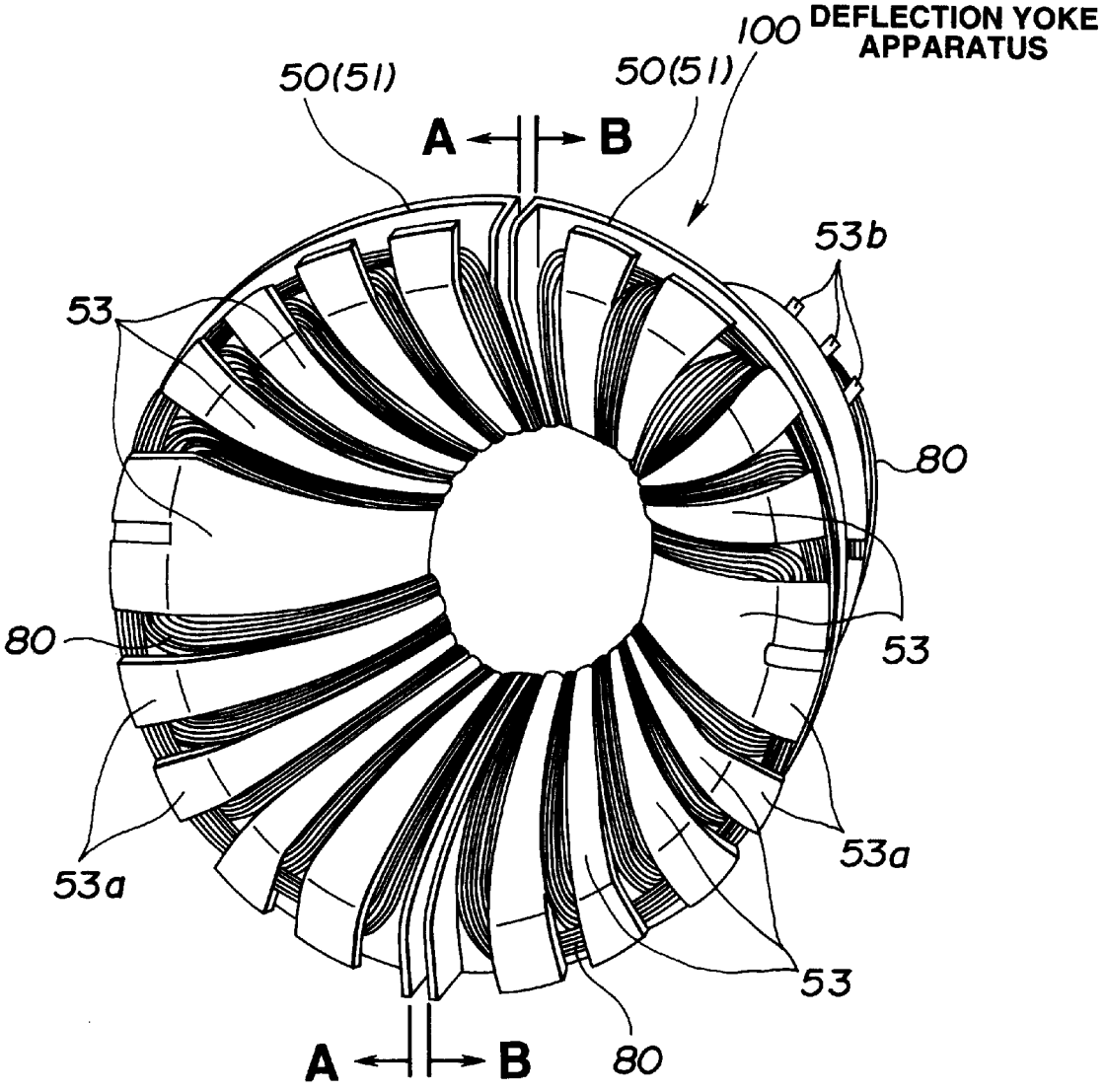
FIG. 11 is a perspective view seen from the screen side of a deflection yoke apparatus according to an embodiment of the invention.
Figure 12:
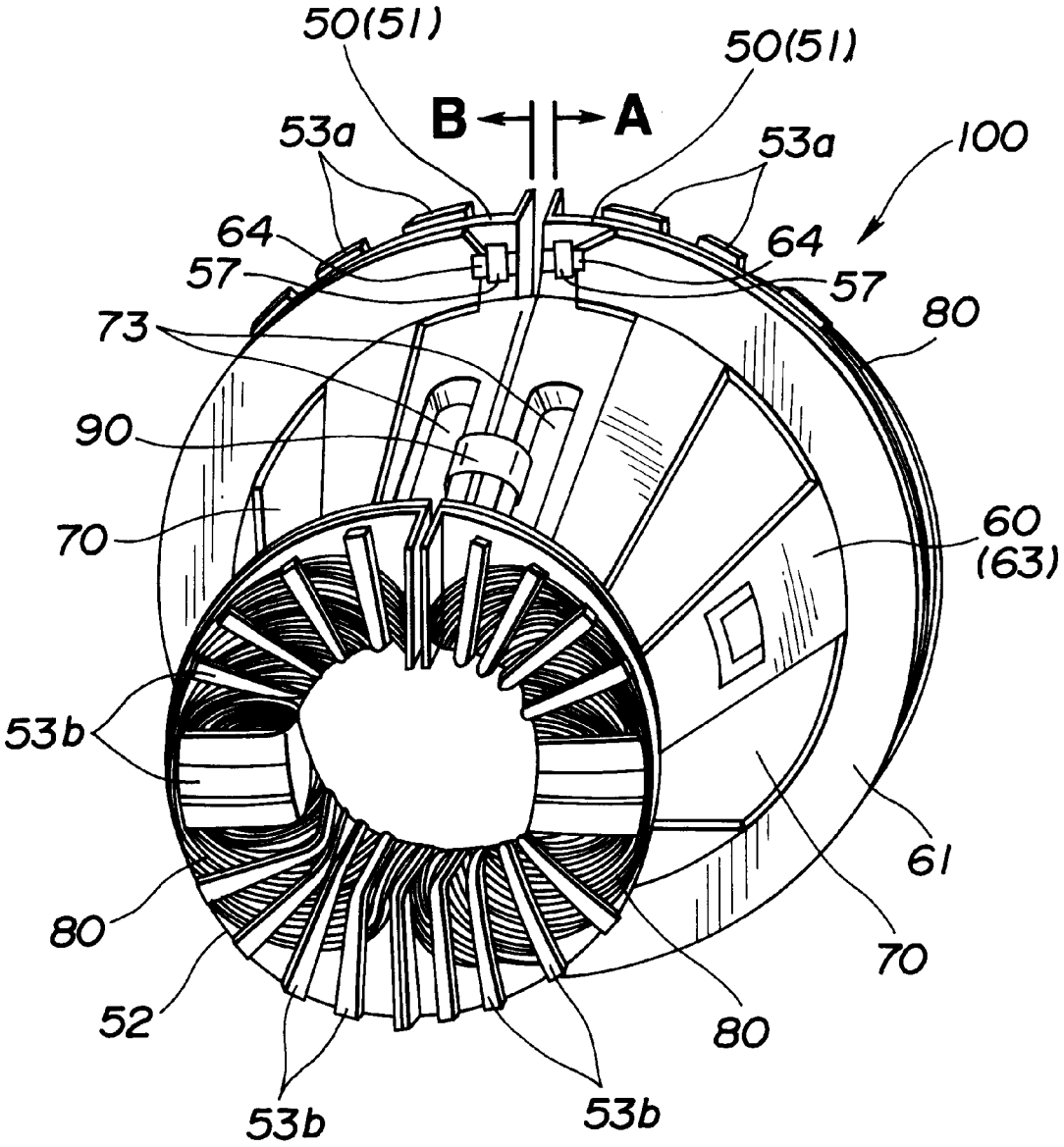
FIG. 12 is a perspective view seen from the neck side of the deflection yoke apparatus in FIG. 11.
Figure 13:
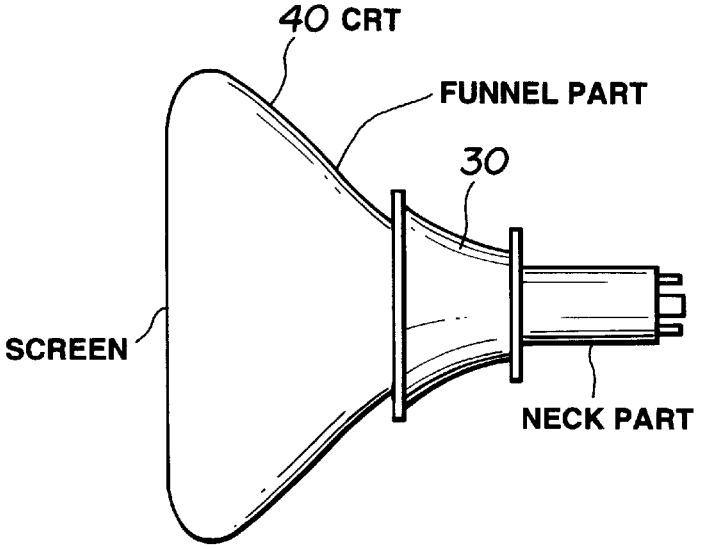
FIG.13 (RELATED ART)
FIG. 13 is a side view illustrating a deflection yoke apparatus when mounted on a CRT.
Figure 14:
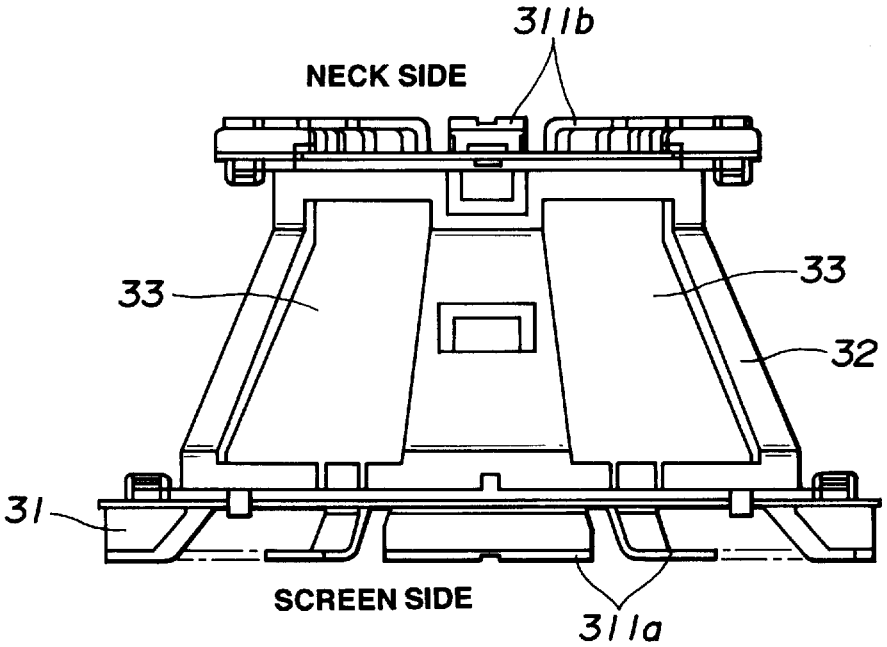
FIG.14 (RELATED ART)
FIG. 14 is a side view of a conventional deflection yoke apparatus before winding.
Figure 15:
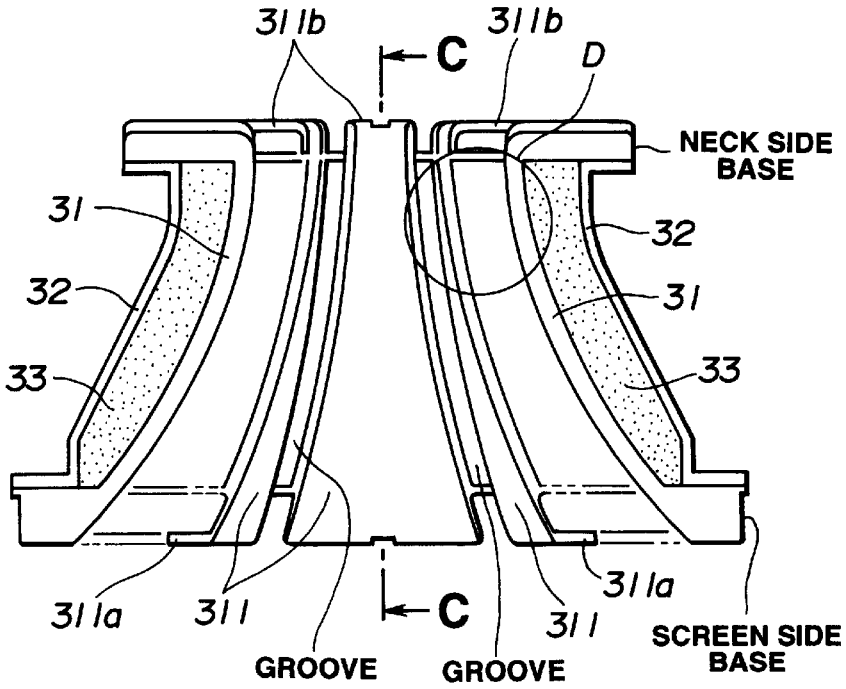
FIG.15 (RELATED ART)
FIG. 15 is a sectional view of FIG. 14.

FIGS. 11 and 12 show a deflection yoke apparatus mounted with a vertical deflection coil which is configured by combining the half bodies of FIG. 8 each other after electric wire is wound. Illustrations of a horizontal deflection coil are not shown. FIG. 11 is a front view (the screen side) and FIG. 12 is a rear view (the neck side).

In these figures, the deflection yoke apparatus which comprises the inner and outer bobbins 50 and 60, the ferrite core 70 and the deflection coil 80 is configured with two half bodies divided along the part A—A and the part B—B shown in FIG. 11. Additionally, two half bodies are combined at the central part with a spring member 90 (see FIG. 12) to be formed in a bell-shape as a whole.

Figure 16:
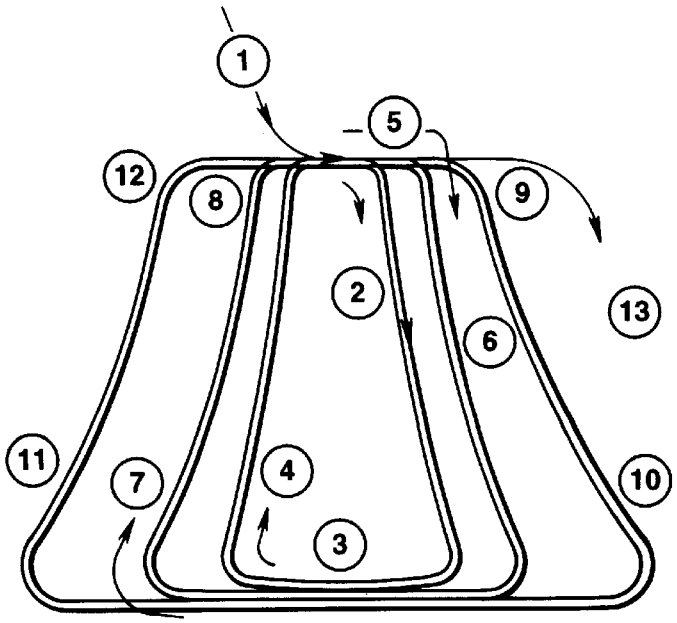
FIG.16 (RELATED ART)
FIG. 16 is an explanatory view illustrating how to wind an electric wire into the inner bobbin.
Figure 17:
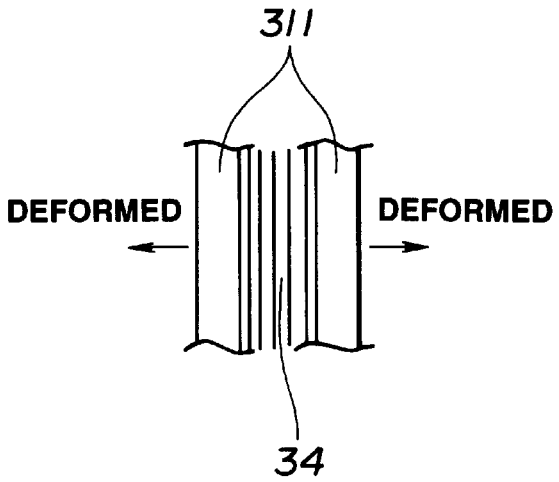
FIG.17 (RELATED ART)
FIG. 17 is an enlarged illustration of discrepant points in a part D when the body in FIG. 15 is wound.
Figure 18:
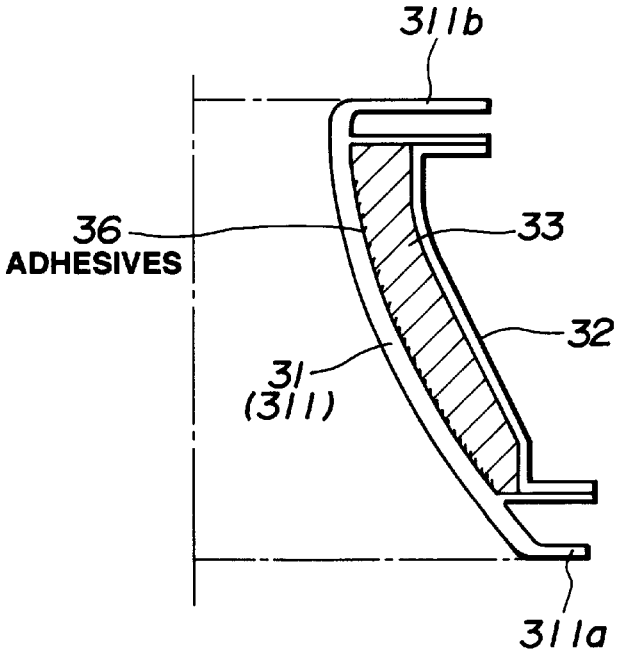
FIG.18 (RELATED ART)
FIG. 18 is a C—C line sectional view of FIG. 15.

The front side (the screen side) of the inner and outer bobbins 50 and 60 is formed expansively opening, and the neck part of CRT is inserted into the inner bobbin 50 from this expansively open side. On each inside face of a pair of the inner bobbins 50, along a plurality of grooves between a plurality of guides 53, a pair of vertical deflection coils 80, 80 are arranged, in which electric wire is wound to generate a magnetic field in the vertical direction of the CRT screen. A deflection coil 80 is latched, as shown in FIG. 11, between the screen side guide hooks 53*a,* which are one ends of a plurality of guides 53 extended over the screen side base 51, and the screen side base 51. Similarly, the deflection coil 80 is latched, as shown in FIG. 12 between the neck side guide hooks 53*b,* which are the other ends of a plurality of guides 53 extended over the neck side base 52, and the neck side base 52. The deflection coil 80 is wound between the screen side base 51 and the neck side base 52 along a plurality of grooves on the inside face of the inner bobbin 50. How to wind the deflection coil 80 is the same as the illustration of FIG. 16.

In the embodiments described above, as a means to fix the ferrite core 70 to the inner bobbin 50, the outer bobbin 60 shown in FIG. 2 is used. However, the present invention should not be limited only to these embodiments but changes may be made; for example, without using the outer bobbin 60, a hook-shaped latching means may be formed in one body to press an outer circumferential edge of the ferrite core 70 down to the inner bobbin 50 on the outside face of the inner bobbin As stated above, according to the present invention, deformation of guides is prevented when a deflection coil is wound, highly accurate distribution of winding is stably obtained, and accordingly, a deflection yoke apparatus with little irregularity in function is realized. Furthermore, a deflection yoke apparatus, which is durable and easy to assemble is realized.

The present invention should not be limited only to the embodiments stated above but various changes and modifications may be made without any departure from the scope of the present invention as defined by the appended claims.

What is claimed is:

1. A deflection yoke apparatus, comprising:

a core which is formed in a shape which is gradually expanding from a neck side toward a screen side, and a bobbin which is arranged along an inner surface of said core, is provided with a screen side base, a neck side base and a plurality of guides formed between the screen side base and the neck side base, and is wound with electric wire in a space between the guide hooks provided at said screen side base and the guide hooks provided at said neck side base to form a deflection coil along grooves formed between said plurality of guides, wherein a bridge is provided in order to connect said plurality of guides formed on said bobbin and to regulate spaces between said plurality of guides.

2. A deflection yoke apparatus, comprising:

a core which is formed in a shape which is gradually expanding from a neck side toward a screen side, and a bobbin which is arranged along an inner surface of said core, is provided with a screen side base, a neck side base and a plurality of guides formed between the screen side base and the neck side base, and is wound with electric wire in a space between the guide hooks provided at said screen side base and the guide hooks provided at said neck side base to form a deflection coil along grooves formed between said plurality of guides, wherein a bridge is provided on the outside face of said plurality of guides formed on said bobbin to regulate spaces between said plurality of guides, and a recess is provided on the inside face of said core to fit with said bridge provided on the outside face of said bobbin.

3. A deflection yoke apparatus according to claim 1 or 2, wherein said bridge is provided at a position about ⅓ to the neck side of the guide length between said screen side base and said neck side base.

* * * * *